United States Patent [19]

Redman

[11] Patent Number: 4,698,640

[45] Date of Patent: Oct. 6, 1987

[54] ADJUSTABLE PLATFORM MOUNTEED HORN ANTENNA

[75] Inventor: Gary M. Redman, Mountain View, Calif.

[73] Assignee: GTE Sprint Communications Corp, Burlingame, Calif.

[21] Appl. No.: 763,494

[22] Filed: Aug. 8, 1985

[51] Int. Cl.[4] ..... H01Q 3/02

[52] U.S. Cl. ..... 343/882; 248/349; 343/786

[58] Field of Search ..... 343/882, 765, 880, 766, 343/763, 762, 878, 786; 350/634, 636, 639; 248/122, 298, 296, 349

[56] References Cited

U.S. PATENT DOCUMENTS

| | | | |
|---|---|---|---|
| 2,510,059 | 6/1950 | Black | 343/882 |
| 3,375,523 | 3/1968 | Laibson | 343/765 |
| 3,510,873 | 5/1970 | Trevisan | 343/784 |
| 3,550,142 | 12/1970 | Dawson | 343/784 |
| 4,171,876 | 10/1979 | Wood | 350/636 |
| 4,342,501 | 8/1982 | Solomon | 350/639 |
| 4,475,110 | 10/1984 | Hutchins | 343/882 |
| 4,563,687 | 1/1986 | Berger | 343/882 |

FOREIGN PATENT DOCUMENTS

| | | | |
|---|---|---|---|
| 0015307 | 1/1984 | Japan | 343/882 |

*Primary Examiner*—Charles Frankfort
*Assistant Examiner*—Thomas B. Will
*Attorney, Agent, or Firm*—Julian Caplan

[57] ABSTRACT

A horn antenna is supported by a pair of axially spaced apart trunion assemblies which are rigidly attached to the upper one of a pair of nested ring shaped members, the lower ring member being rigidly attached to a platform. Flat ring shaped flanges on the tops of the members are in contact for rotatably supporting the upper ring member in the lower ring member. Rotation of the antenna is accomplished with a turnbuckle that is connected between the perimeters of the two flanges. Each trunion assembly comprises a bolt that is welded to the top of the upper flange and that has a nut thereon supporting one side of the antenna. Elevation adjustment of the antenna is accomplished by threading the nut on the trunion bolt for raising or lowering the associated side of the antenna.

17 Claims, 31 Drawing Figures

ADJUSTABLE PLATFORM MOUNTEED HORN ANTENNA

BACKGROUND OF INVENTION

This invention relates to platform mounting of horn antenna assemblies and more particularly to an adjustable mount for horn antenna assemblies.

One known arrangement for mounting a horn antenna assembly on a platform comprises a first member that is a circular I-beam member and a second member that is a hexigonally shaped I-beam member. The first member is bolted to the top of the platform. The second member is set on top of the first (circular) member. The horn antenna assembly is attached to and located in the central opening in the top member. The lateral position of the two members is fixed by wheels on outboard flanges of the top member. The wheels contact the circumference of the first member. Alignment of the antenna is achieved by rotating the hex-shaped member on top of the circular member. The alignment is maintained with clamped compression bars which create a binding force between the two stacked members. It has been found that there can a rotational misalignment between the top and bottom members which reduces the precision and repeatability of an associated alignment procedure. This problem is compounded when the rollers are removed from the top member. Another prior art mounting structure for a horn antenna assembly comprises a rotatable ring member having an I-beam shaped cross section and a plurality of support members that are bolted to the top of a platform. The support members have extensions or arms thereon that extend into the openings in the ring shaped I-beam for suspending it above the platform. A compression band that extends around the circumference of the I-beam is supported by the arms. Alignment of the antenna is accomplished by rotating the ring on the support members. The alignment is maintained with the compression bands. It has been found that tightening the compression ring causes the antenna to move out of alignment. One method of leveling the antenna assembly along a horizontal axis thereof is to place shims under selected points around the fixed member. This technique is time consuming and does not provide repeatable results. Another technique for leveling the antenna in the horizontal plane is to adjust the position of the support platform. This approach also is unsatisfactory in that it does not provide repeatable results.

An object of this invention is the provision of improved apparatus for rotatably mounting an antenna assembly.

SUMMARY OF INVENTION

In accordance with this invention, apparatus for rotatably supporting an antenna assembly at an elevated location above the ground comprises: support means extending in a generally vertical direction above the ground; a first support member having a cylindrical portion and a flat ring-shaped flange portion rigidly attached to the top of said cylindrical portion thereof; means for rigidly nonrotatably securing said first support member to said support means; a second support member having a cylindrical portion and a flat ring-shaped flange portion that is rigidly secured to the cylindrical portion thereof; the diameter of the cylindrical portion of the second support member and one of a larger and smaller diameter on said first support member being dimensioned for smoothly nesting said second support member either in or over said first support member with the ring portions thereof in supportive contact over substantial portions of surface areas thereof and for enabling the second support member to smoothly rotate either in or on said first support member; and first means for attaching the antenna assembly to said second support member whereby rotation of said second support member with respect to said first support member causes desired rotation of the antenna assembly.

DESCRIPTION OF DRAWINGS

This invention will be more fully understood from the following detailed description of preferred embodiments thereof together with the figures of drawings wherein.

The parts are drawn in the various figures for illustrative purposes only and are not necessarily drawn to scale, associated nuts and bolts and welding points (illustrated by fillets) being omitted in certain places for clarity of illustration and description.

DESCRIPTION OF PREFERRED EMBODIMENTS

Figure 1:
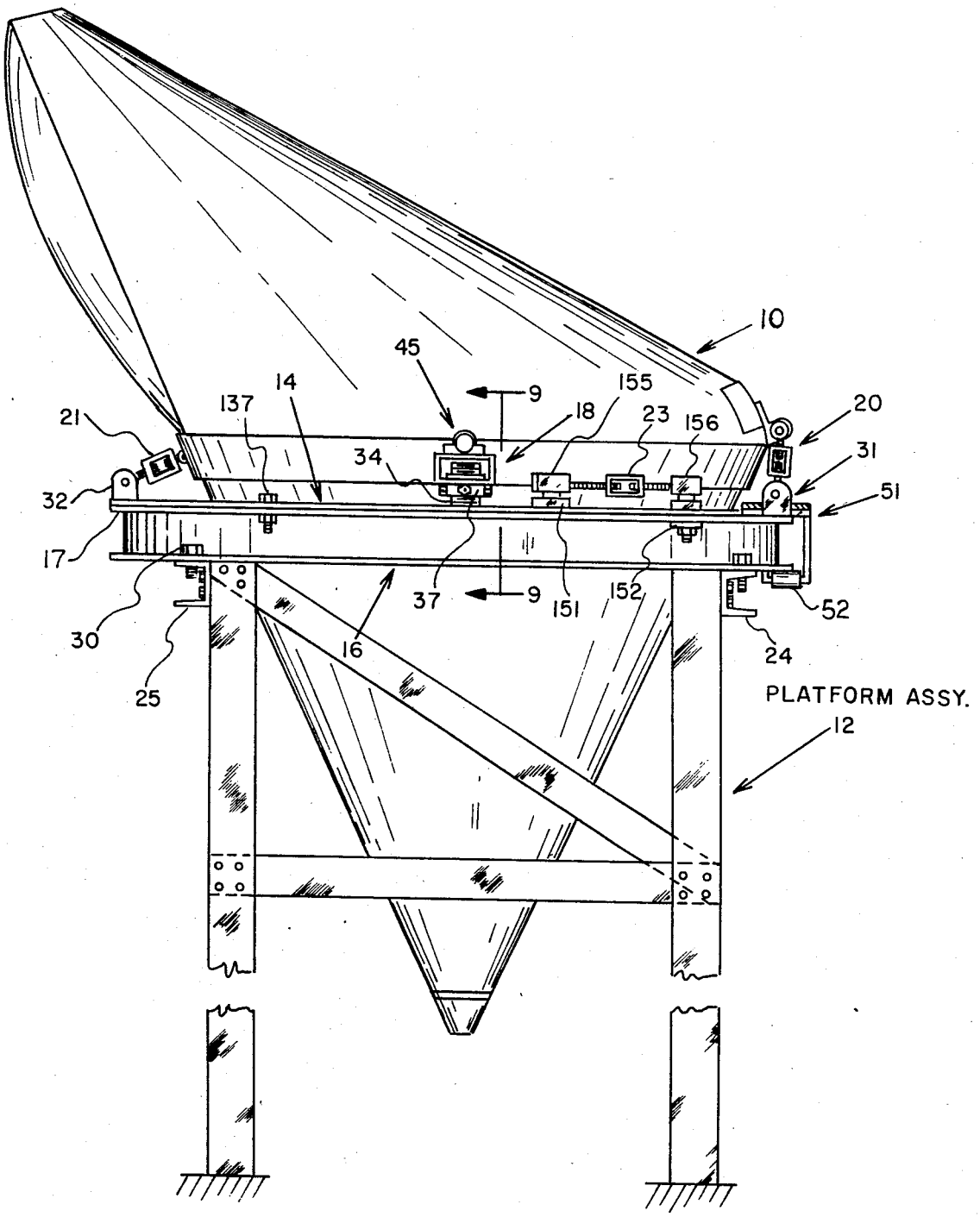
FIG. 1 is an elevation view of a platform mounted antenna assembly embodying this invention.
Figure 2:
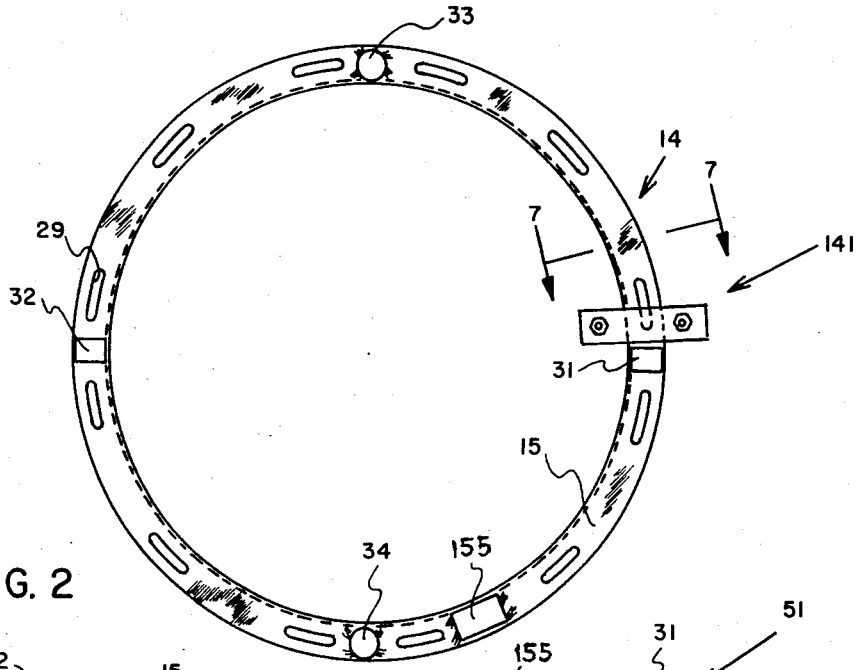
FIG. 2 is a top view of the upper ring mount 14 in FIG. 1 with a clamp-roller assembly 51 thereon.
Figure 3:
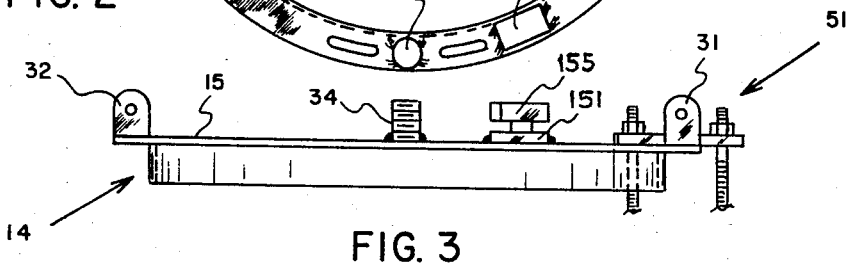
FIG. 3 is a front elevation view of the ring mount 14 in FIG. 2.
Figure 4:
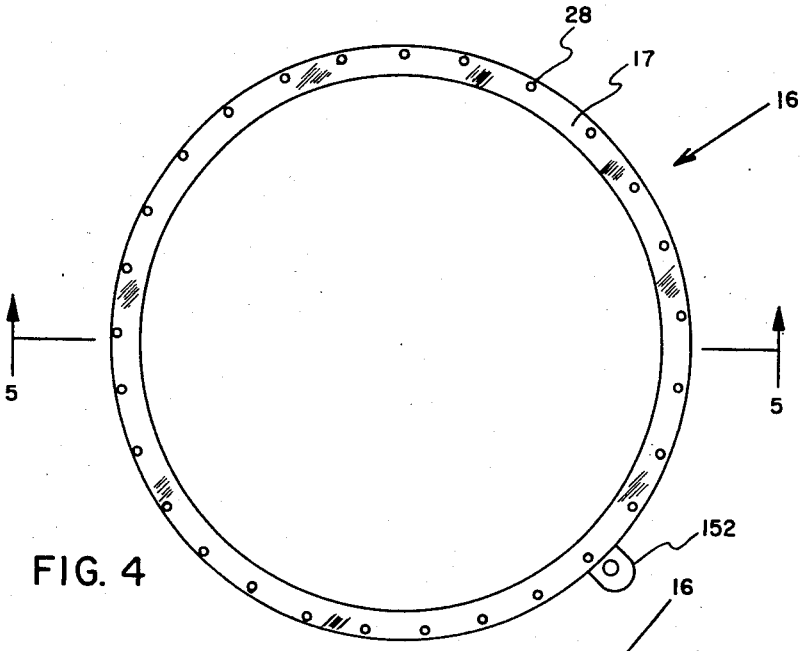
FIG. 4 is a top view of the lower ring mount 16 in FIG. 1.
Figure 5:
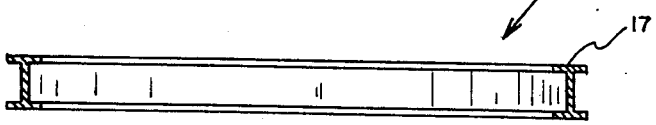
FIG. 5 is a section view of the ring mount 16 taken along line 5—5 in FIG. 4.
Figure 26:
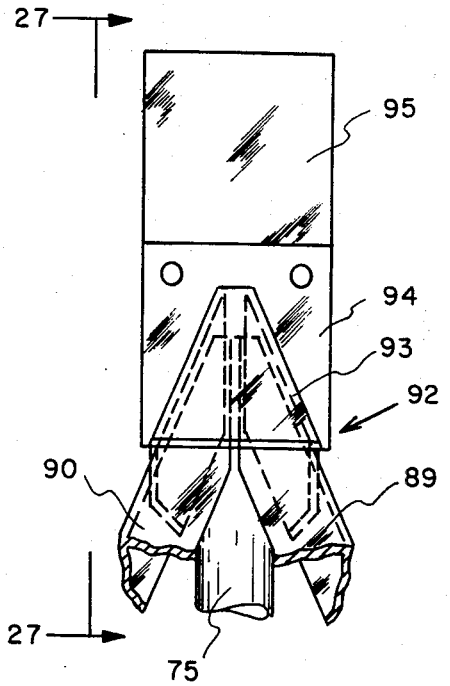
FIG. 26 is a front elevation view taken along line 26—26 in FIG. 10 and showing the bracket assembly 92.
Figure 6:
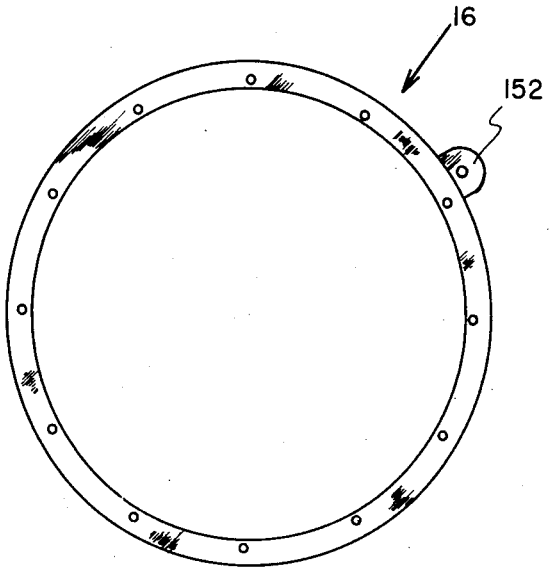
FIG. 6 is a bottom view of the lower ring mount 16 in FIGS. 4 and 5.
Figures 7, 10:
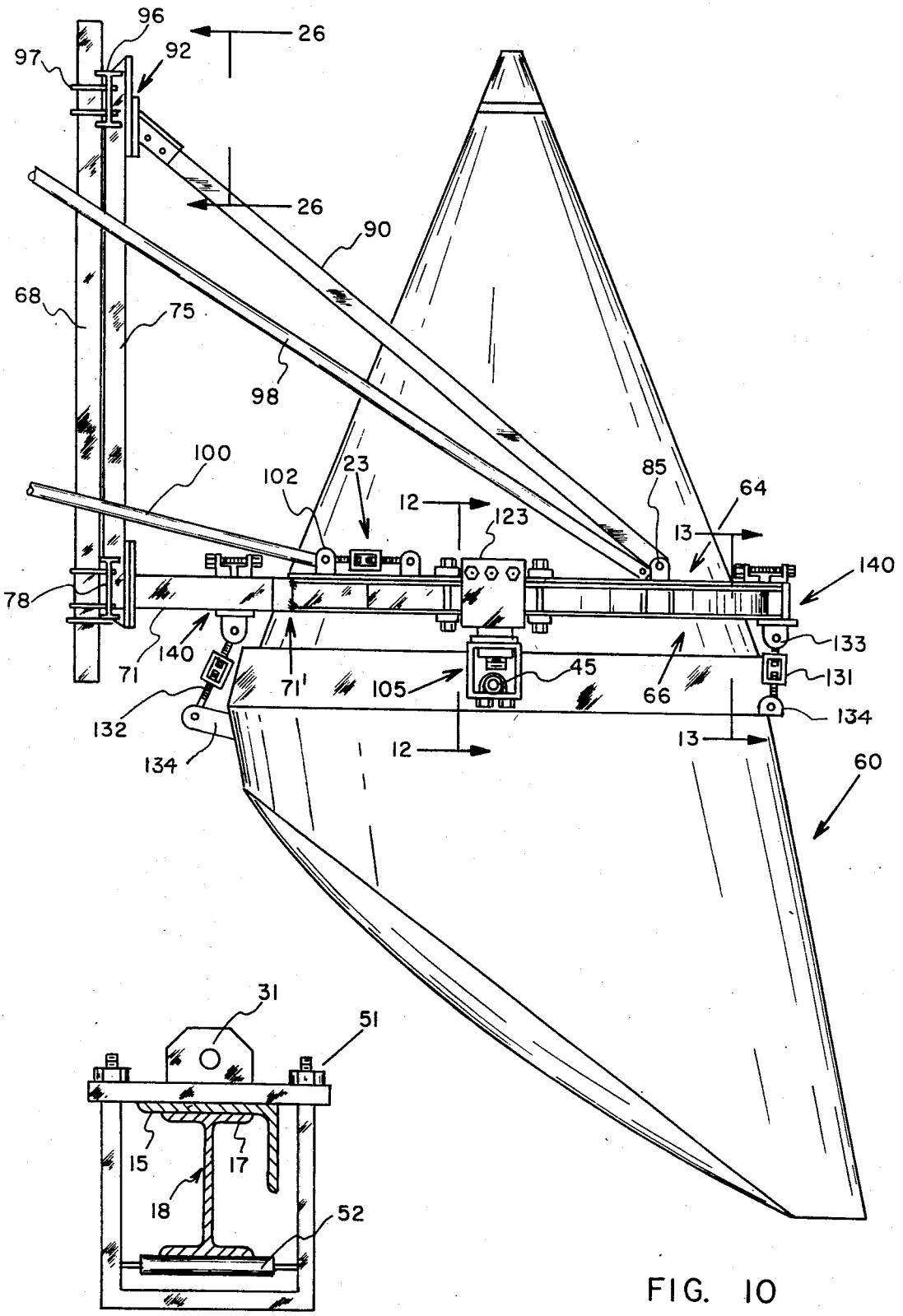
FIG. 7 is a section view taken along line 7—7 in FIG. 2 when the upper and lower ring mounts are nested as is illustrated in FIG. 1, i.e., taken along cutting lines so as to be out of the plane of the paper in FIG. 1.
FIG. 10 is an elevation view of an alternate embodiment of this invention for rotatably supporting a horn antenna assembly 60 in an inverted orientation.
Figure 9:
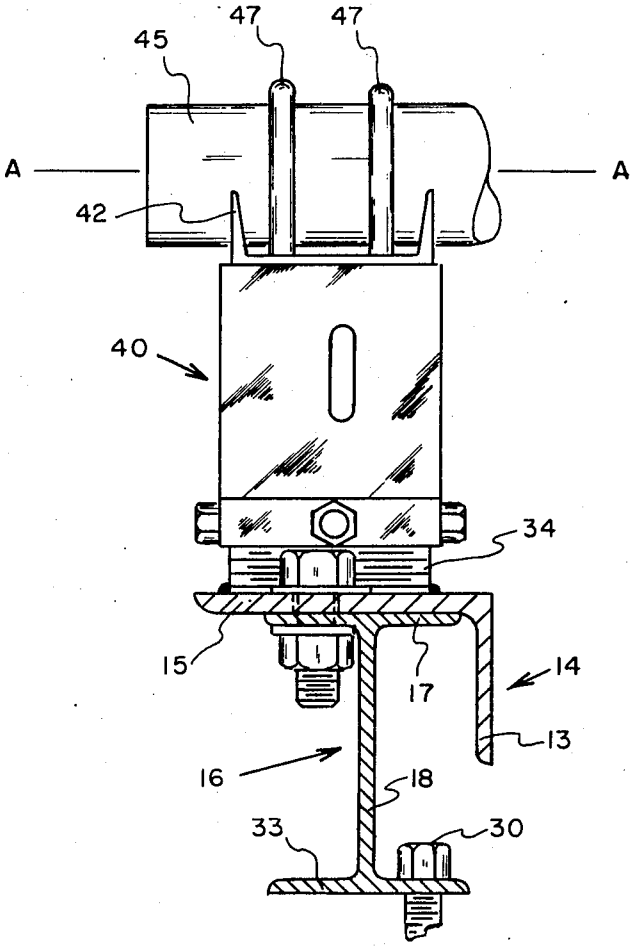
FIG. 9 is a section view taken along line 9—9 in FIG. 8.
Figure 8:
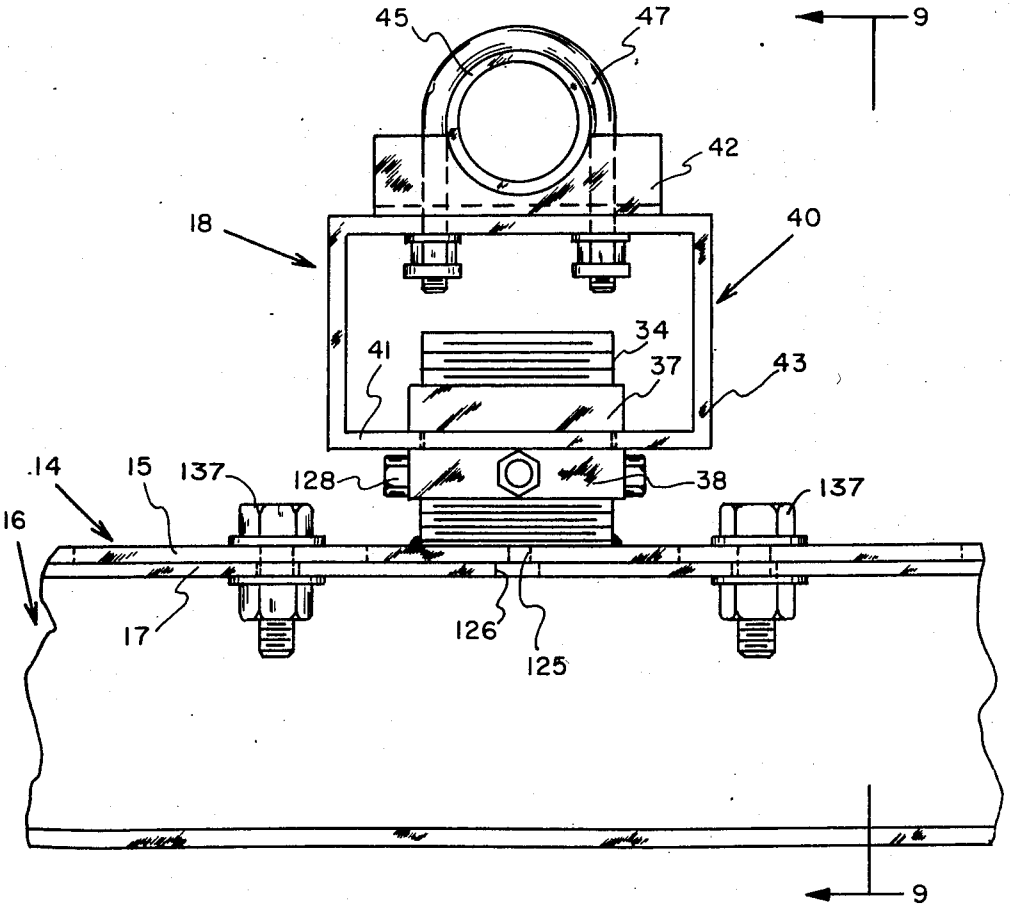
FIG. 8 is a greatly enlarged front elevation view of the vertical adjustment assembly 18 in FIG. 1.

Referring now to FIG. 1, apparatus for mounting a horn antenna assembly 10 on the top of a platform assembly 12 comprises upper and lower ring mount members 14 and 16, a pair of vertically adjustable trunnion mounting assemblies (only one assembly 18 being shown in FIG. 1), a pair of turnbuckles 20 and 21 that connected between flanges on the upper ring member 14 and the horn antenna assembly, and a third turnbuckle 23. The lower ring mount 16 is bolted by bolts 30 to beams 24–25 on the top of the platform so that this ring is held there and restrained from rotational movement. The upper ring member 14 which may consist of annular flange 15 and cylindrical flange 16 is rotatably nested in the lower ring member 16 with the annular flange 15 of the upper ring member resting on the top 17 of the lower ring member which may have a cross section which is shaped like an I-beam as is illustrated in FIGS. 7 and 9. An anti-seize compound is spread over the mating surfaces of the flange 15 and top 17 to facilitate rotation of the top ring on the lower ring. The lower ring member may be strengthened by welding ribs between the top and bottom portions of the lower ring member. Flanges 31 and 32 and short lengths of heavy duty threaded pipes 33 and 34 are welded at 90° intervals to the top of the cylindrical flange 15 on the upper ring member as is illustrated in FIGS. 2, 3, and 7–9. A plurality of base plates 151 of swivel blocks 155 (only one of which is shown in FIGS. 1–3) are welded to the top of the flange 15 on the upper ring member. The top disk 17 of the lower ring member has a large number of bolt holes 28 extending through it on the same bolt circuit as a smaller number of elongated holes or slots 29 in the cylindrical flange 15 on the upper ring member. (See FIGS. 4 and 2). A plurality of flanges 152 (only one of which is shown in FIGS. 1, 4 and 6) are welded to the bottom of the top ring 17 on the lower ring member. A swivel block 156 is bolted to flange 152 (see FIG. 1).

The trunnion mounting assembly 18 (see FIGS. 8 and 9) attached by bolts 30 to beams 24, 25 of platform assembly comprises the threaded pipe 34 which is welded to the cylindrical flange 15 of the upper ring member, a pair of pipe nuts 37 and 38, and a rectangularly shaped section 40 of structural tubing that has a hole in the bottom 41 thereof so that the bottom 41 is sandwiched between the pipe nuts 37 and 38 on the threaded pipe 34. Thus, the tube section 40 comprising a section of rectangular mechanical tubing 43 is essentially supported on the lower pipe nut 38. A support 42 on top of the tube section 40 in FIGS. 8 and 9 holds the trunnion pipe 45 of the antenna assembly which is firmly held in place by U-clamps 47. A second trunnion mounting assembly in a diametrically opposite position (not shown) on the threaded pipe 33 on the upper ring member supports the other trunnion pipe (not shown) of the horn antenna assembly so that the latter is rotatable about the axis A—A in FIG. 9 that extends through the trunnion pipes on the antenna assembly.

Figure 13:
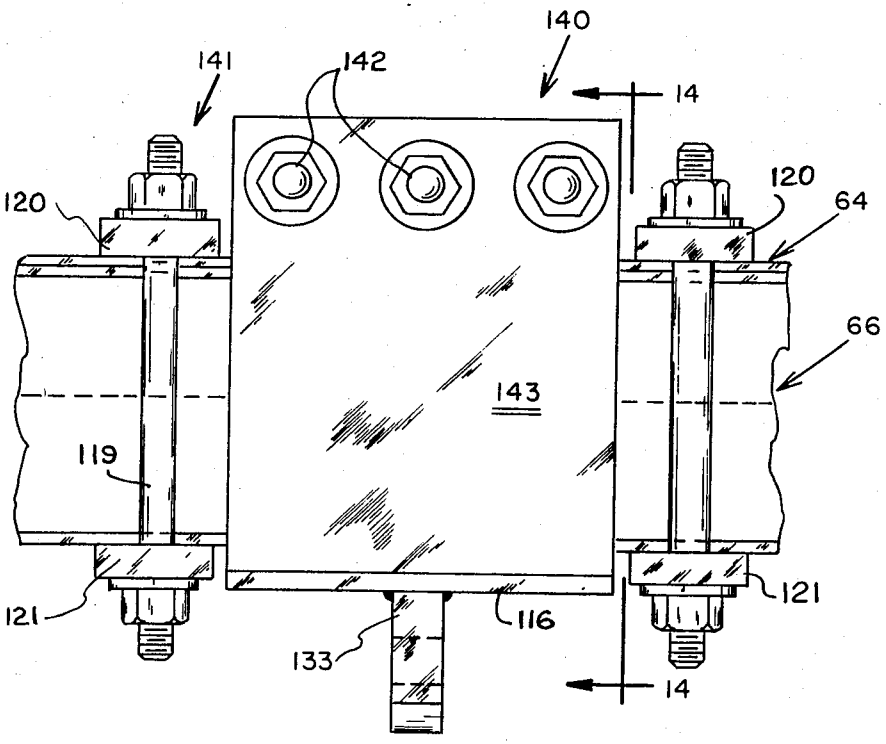
FIG. 13 is an elevation view taken along line 13—13 in FIG. 10 and illustrating the lock-down clamp assembly 141.
Figure 14:
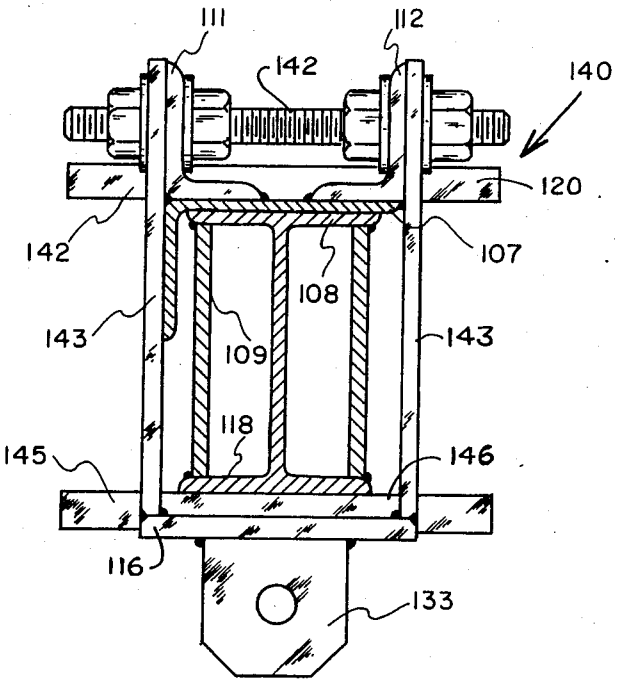
FIG. 14 is a section view taken along line 14—14 in FIG. 13.

Again referring to FIG. 1, the turnbuckles 20 and 21 extend between flanges on the upper ring member and the antenna assembly and are used to rotate the antenna assembly about its trunnion axis A—A in order to effectuate elevation adjustment of the antenna. A plurality of clamp assemblies 51 are located around the circumference of the ring members for preventing ring 14 tilting upward in ring 16 while roller 52 allows rotation of the nested rings. The turnbuckle 23 is connected between the swivel blocks 155 and 156. This turnbuckle 23 is used to rotate the upper ring 14 on the lower ring member 16 for effectuating azimuthal adjustment of the antenna assembly. Although the beams 24–25 on the top of the platform assembly are made to be substantially level, fine adjustment of the level of the axis A—A of rotation of the antenna is effected by loosening the top pipe nut 37 and turning the lower pipe nut 38 so as to raise or lower the tubular section 40 and the trunnion pipe 45 thereon. When the desired orientation of the antenna axis A—A is obtained, the upper pipe nut 37 is tightened against the plate 41 and lower pipe nut 38, lock nuts on the turnbuckles are tightened, and bolts 137 that extend through holes in the upper and lower ring members are firmly secured in place to prevent rotation thereof and movement of the antenna. Alternatively lock-down clamp means 141 in FIG. 13 may be used to fix the position and orientation of the ring members.

Referring now to FIG. 10, apparatus for supporting a horn antenna assembly 60 in an inverted position comprises a pole mounted platform including a pair of concentric ring members 64 and 66, one ring 66 being fixed and the other ring 64 being rotatable on the one ring 66.

Figure 25:
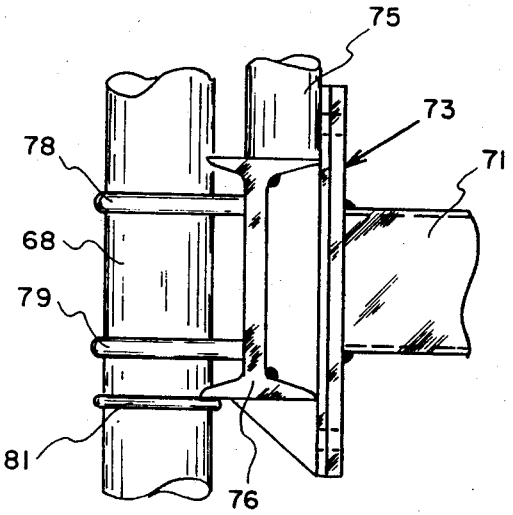
FIG. 25 is a side elevation view taken along line 25—25 in FIG. 15 and showing the lower mount structure.
Figure 27:
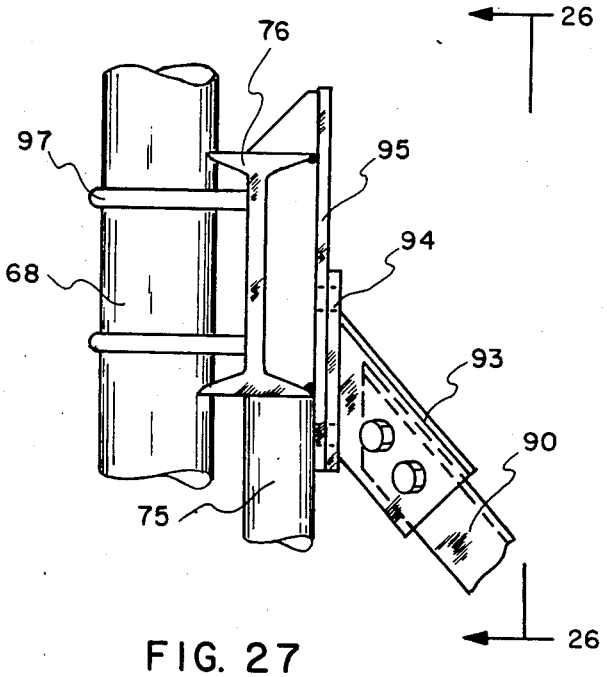
FIG. 27 is a side elevation view taken along line 27—27 in FIG. 26 and showing the upper mount structure.
Figure 15:
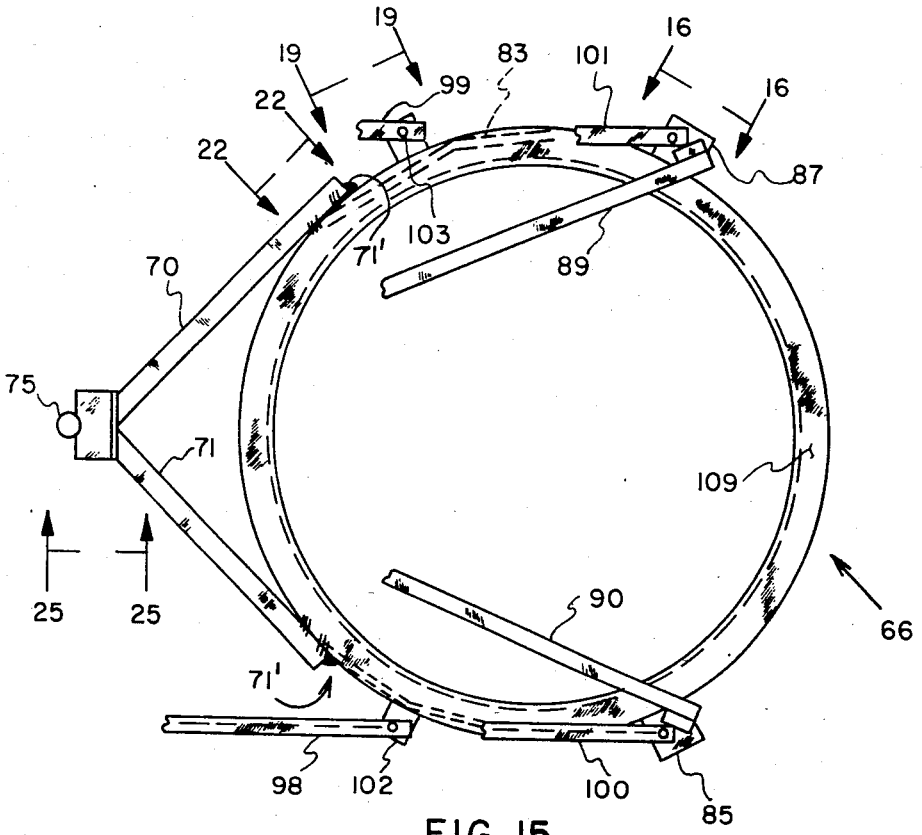
FIG. 15 is a top view of the lower ring mount 66 of FIG. 10.
Figure 18:
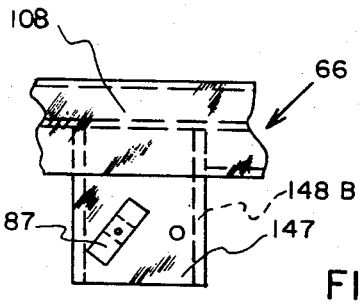
FIG. 18 is a top plan view taken along line 18—18 in FIG. 16.
Figure 16:
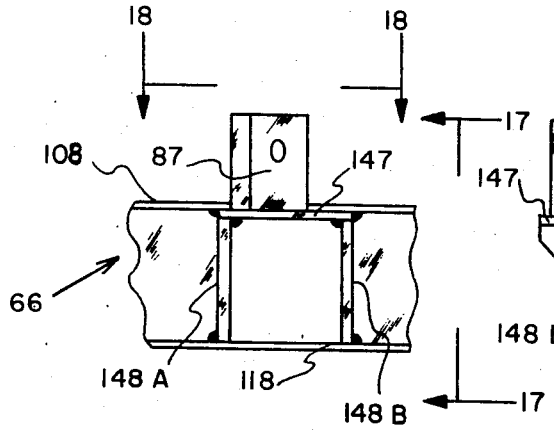
FIG. 16 is a front elevation view taken along line 16—16 in FIG. 15.
Figure 17:
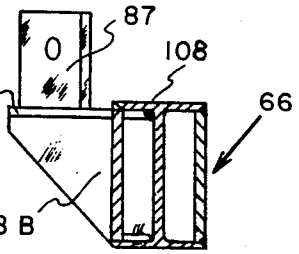
FIG. 17 is a side elevation view taken along line 17—17 of FIG. 16.
Figure 21:
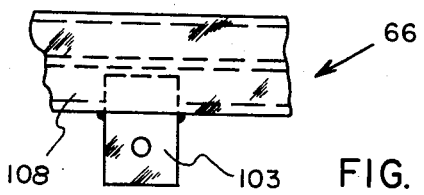
FIG. 21 is a top plan view taken along line 21—21 in FIG. 19.
Figures 19, 20:
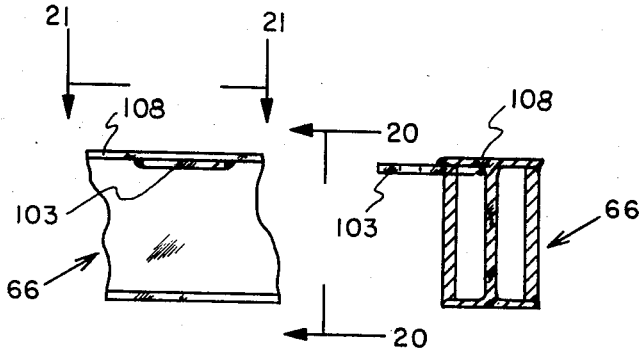
FIG. 19 is a front elevation view taken along line 19—19 in FIG. 15.
FIG. 20 is a side elevation view taken along line 20—20 in FIG. 19.
Figures 22, 23, 24:
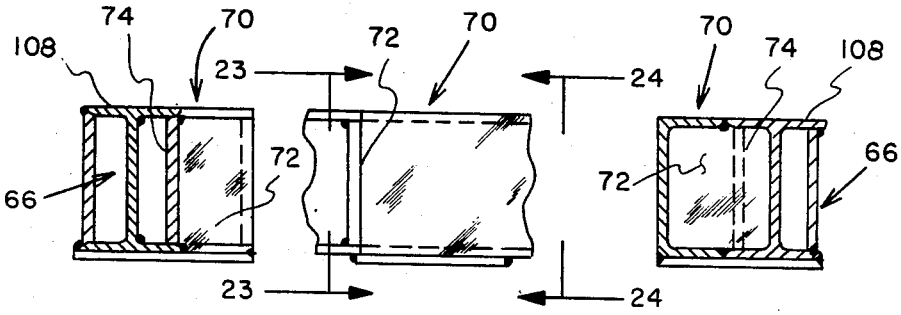
FIG. 22 is a front elevation view taken along line 22—22 in FIG. 15.
FIG. 23 is a section view taken along line 23—23 in FIG. 22.
FIG. 24 is a section view taken along line 24—24 in FIG. 22.
Figure 28:
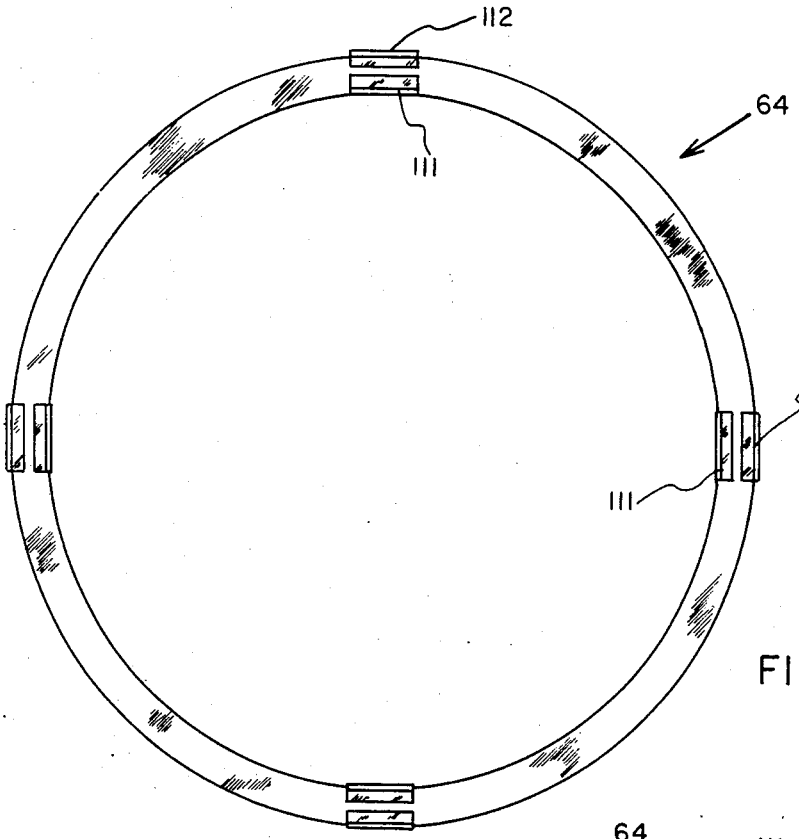
FIG. 28 is a top plan view of the upper ring mount 64 in FIG. 10.
Figure 29:
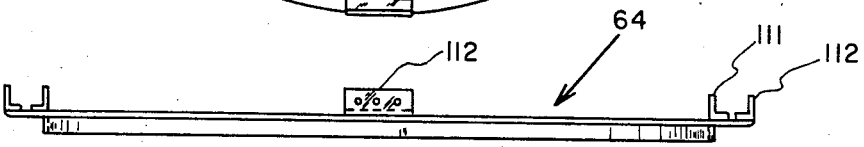
FIG. 29 is a front elevation view of the upper ring mount 64 in FIG. 28.

Clamps 105 at spaced intervals securing members 64, 66 radially. Clamp 105 comprises vertical plates 143 positioned on opposite sides of flanges 111 and 112 welded to members 64. Tightening the nuts on bolts 142 draws members 114, 114 together to perform the clamping force. Separator 146 holds the lower ends of plates 113, 114 and 143 apart. At spaced intervals are vertical clamp bolts 119 which fit through top and bottom radial plates 120, 121 which bear against upper and lower ring members 64, 66. Tightening the nuts on bolts 119 applies the clamping pressure. The fixed ring 66 is attached to a pole 68, that may be supported on a platform (not shown), by beams 70 and 71 (see FIGS. 15 and 25) that are welded by welds 71′ to plate 73 that is bolted to a second plate 74 in the field, the plate 74 being welded to a second pipe 75 that is welded to an I-beam section 76 that is attached to the support pole 68 by U clamps 78 and 79 with the bottom of the I-beam section 76 resting on a rigid cylindrical flange 18 on the pole 68. The other ends of the beams 70 and 71 may be welded or bolted to the lower ring member 66 with stiffener plates 83 welded to the top and bottom cylindrical disks of the ring member 66 (see FIGS. 15 and 22–24). To rigidify the attachment of flange 87 to member 66, stiffeners 147, 148A and 148B may be used, as best shown in FIGS. 16–18. Alternatively, a circular stiffner ring could be located inside the I-beam 66 and welded thereto in place of plates 83. Flanges 85 and 87 that are welded to the underside of the outboard edge of the lower ring member 66 are also attached through cross braces 89 and 90 to a bracket assembly 92 at the top of the pole 68 (see FIGS. 10, 15, 26 and 27). Bracket assembly 92 may comprise sockets 93 receiving the upper ends of cross braces 89, 90 the sockets 93 being attached to plate 94 fixed to plate 95 welded to horizontal beam section 76. Beam section 76 is clamped to pole 68 by U-bolts 78, 79. Cross arms 98 and 99 are also connected between the flanges 85 and 87 and the tower (not shown). Additionally, horizontal stiffener arms 100 and 101 are connected between flanges 102 and 103 on the underside of the lower ring member and the tower (see FIGS. 10 and 15).

Figure 11:
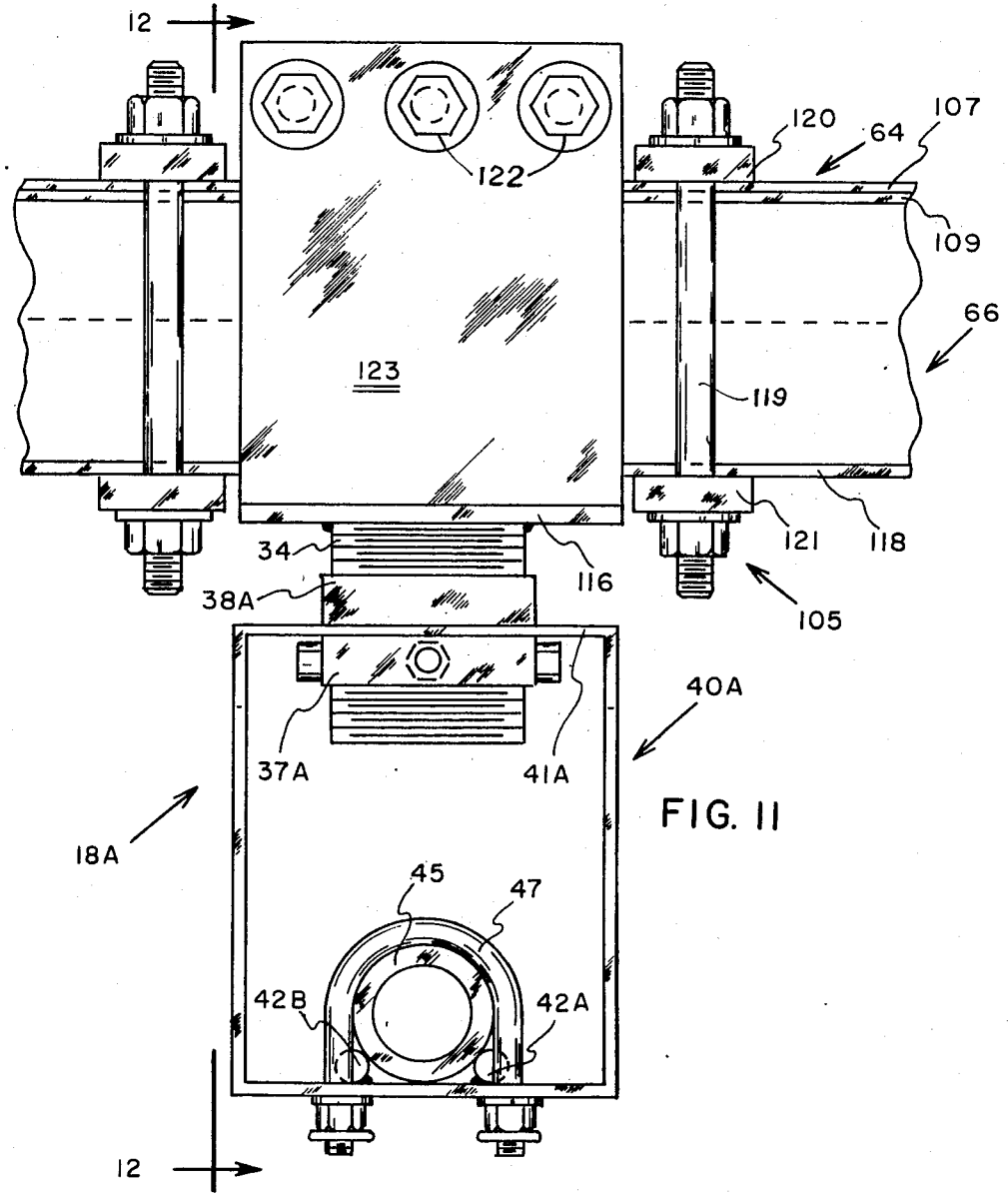
FIG. 11 is a greatly enlarged front elevation view of the vertical adjustment assembly 105 in FIG. 10.
Figure 12:
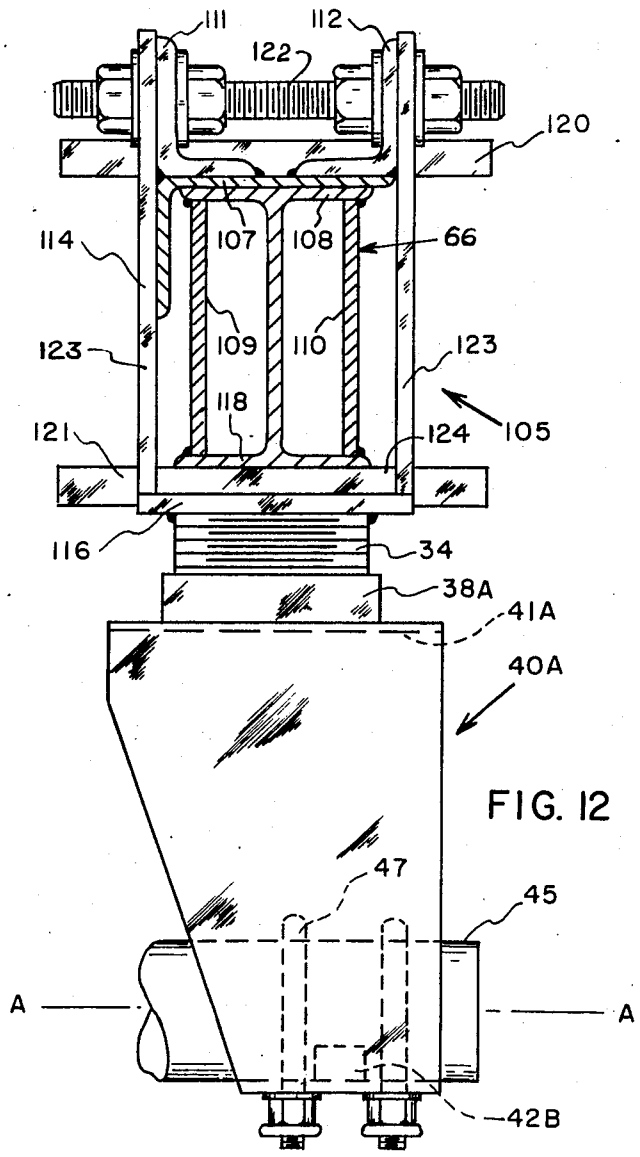
FIG. 12 is a section view taken along line 12—12 in FIGS. 10 and 11.

The horn antenna 60 is supported by a pair of adjustable trunnion devices, only one device 105 being shown in FIG. 10, that are attached to the upper-rotatable ring member 64 (see FIGS. 11 and 12). Reference to FIG. 12 reveals that the width of the top-support flange 107 of the upper ring member 64 is greater than that of the top 108 of the lower support member. A pair of flanges 111 and 112 which extend beyond the top 108 of the lower ring member, are welded to the top of support flange 107. Stiffener plates 109 and 110 may be welded to the edges of beam 66 to add torsional stability. A member 114 having a U-shaped cross section formed of spaced vertical plates 23 spaced apart at their bottoms by plate slides up over the flanges 111–112 to form an assembly that is bolted together by radially extending bolts 122 to make up an integral structure that has the bottom 116 thereof located below the lower cylindrical disk portion 118 of the lower ring member. The threaded pipe 34 is welded to the bottom 116 of this assembly and supports a structural tube 40A that has its top 41A sandwiched between pipe nuts 37A and 38A on the pipe 34 (see FIG. 11). This assembly supports the trunnion pipe 45 on the antenna assembly in a manner previously described in relation to the structure in FIGS. 8 and 9, the same reference numerals followed by subscripts A and B describing corresponding elements. Initial azimuthal alignment of the antenna assembly 60 may be accomplished by rotating the elevated mounting assembly in FIG. 10 around pole 68 prior to tightening the U-bolts 78 and 97 thereon. Fine adjustment of the azimuthal direction of the antenna is accomplished by rotating the upper ring member 64 on the lower ring member 66. The nested rings 64 and 66 are held together by a plurality of clamp means 140 shown in FIG. 13 or means similar to that in FIG. 7.

Figure 31:
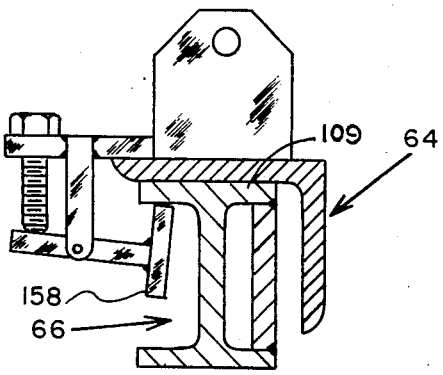
FIG. 31 is a section view illustrating an alternate hold down structure that allows for rotation of the nested ring members.

Clamp means 140 comprises a pair of spaced vertical plates 143 separated at their bottoms by spacer 146 and drawn together at their tops by the nuts on bolts 142 which also pass through flanges 111 and 112. Alternatively the nested ring members may be held in place during rotational adjustment by the clamp means in FIG. 31 where the wheel 158 contacts the bottom of ring 109 during adjustment. Vertical alignment and horizontal levelling are accomplished in the manner previously described for the assembly in FIG. 1.

Note, as best shown at FIG. 10, turnbuckles 131, 132 attached to ears 133 on the clamp means 140 and ears 134 on the horn assembly 60. Fine adjustment is made by turning said turnbuckles 131, 132.

Figure 30:
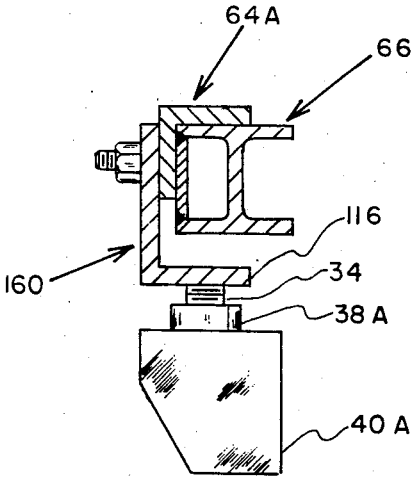
FIG. 30 is an elevation view of an alternate embodiment.

Although this invention is described in relation to preferred embodiments thereof, variations and modifications are possible. By way of example, drain holes 125 may be drilled through the upper support member 14 and drain holes 126 through lower support members 16 inside the pipe 34 in FIG. 8 and around exposed nuts and bolts. Also, the nuts 37 and 38 may be other than pipe nuts and may have extensions such as nuts 128 in FIG. 8 welded to the circumference thereof for aiding in rotating the pipe nuts. And the pipe 34 and tubular section 40 may be other than round and rectangularly shaped, although this is not seen to be of particular advantage. Additionally, the lower ring 16 could be the inner ring of the nested pair thereof. Further, either or both of the ring members may have angle iron shaped cross sections or I-beam shaped cross sections, with either the upper or lower ring member being the outer one thereof and with the cylindrical portions thereof either being adjacent or spaced apart. Additionally, the adjustable trunnion assembly 105 may be configured as is illustrated in FIG. 30, wherein upper ring member 64A is bolted by bolt 152 to angle 160. The lower flange 116 of angle 160 is attached, as by welding, to pipe 34 which is threaded into nut 38A fixed to tube 40A. The scope of this invention is therefore to be determined from the appended claims rather than from the aforementioned detailed descriptions of preferred embodiments thereof.

What is claimed is:

1. Apparatus for rotatably supporting an antenna assembly at an elevated location comprising:

support means extending in a generally vertical direction above ground;

a first support member having a first cylindrical portion and a flat first circumferential ring-shaped flange portion having a larger and a smaller diameter that is rigidly attached to said cylindrical portion thereof;

means for rigidly nonrotatably securing said first support member to said support means;

a second support member having a second cylindrical portion and a flat second circumferential ring-shaped flange portion that is rigidly secured to the cylindrical portion thereof; the diameter of said second cylindrical portion and of one said diameter on said first support member being dimensioned for smoothly nesting said second support member either in or over said first support member with the ring portions thereof in supportive contact over substantially the entire surface areas thereof and for enabling the second support member to smoothly rotate either in or on said first support member; and first means for attaching the antenna assembly to said second support member whereby rotation of said second support member with respect to said first support member causes desired rotation of the antenna assembly, the height of said cylindrical portion being less than the height of said first cylindrical portion, and fixing means for rigidly fixing the rotational position of said second support member with respect to said first support member comprising clamp means for selectively squeezing said first and second support members together to create a frictional force between ring portions thereof which prevents rotation thereof.

2. Apparatus according to claim 1 further comprising friction reducing bearing surface means on at least one of said ring portions of said first and second support member, respectively.

3. Apparatus according to claim 1 wherein said fixing means comprises a plurality of round holes extending through one of said ring portions and a plurality of elongated holes in the other of said ring portions and bolts extending through said holes and nuts on said bolts operable to be tightened for squeezing said ring portions together for preventing rotation of said second support member.

4. Apparatus according to claim 2 wherein said attaching means comprises support means for rotatably supporting said antenna assembly on the second support member so that the antenna assembly will rotate about a first axis and in a first plane that is orthogonal to the first axis, for tilting the antenna assembly in the first plane.

5. Apparatus according to claim 4 wherein said first support means is operable for adjusting the orientation of said first axis in a second plane that is orthogonal to the first plane for leveling the antenna assembly in the second plane.

6. Apparatus according to claim 5 wherein said first support means comprises:

a rigid member having a threaded exterior surface and having a longitudinal axis of said threads;

second means for rigidly attaching said threaded member to said second support member with the thread axis substantially orthogonal to the plane of said second ring-flange;

first nut means screwed onto said threaded member;

a rigid tubular shaped enclosure having an opening through one side thereof that is dimensioned for making a smooth sliding fit over said threaded member;

second nut means screwed onto said threaded member with said one side of said tubular enclosure on said threaded member being located between said first and second nut means;

clamp means attached to and rotatably supporting one of a pair of trunnion support members on the antenna assembly; and third means for rigidly attaching said clamp means to said tubular enclosure so as to support said antenna assembly for rotation about its axis of rotation through the trunnion support members thereof;

adjustment of the orientation of the axis of rotation of the antenna assembly being varied by screwing said first nut means up and down the circumference of said threaded member whereby the antenna assembly is levelled in the second plane including the axis of rotation of the antenna assembly and being substantially orthogonal to the first plane, said second nut means being tightened against said one side of said enclosure in the direction of said first nut means for fixing the orientation of the axis of rotation of the antenna assembly.

7. Apparatus according to claim 6 wherein the exterior of said threaded member is circularly shaped.

8. Apparatus according to claim 7 wherein said enclosure is regularly shaped.

9. Apparatus according to claim 1 wherein said antenna assembly includes a pair of trunnion means on opposite sides thereof enabling rotation of the antenna assembly about an axis therethrough; said first means comprising bracket means rigidly connected to said second support member and having a rigid flat support plate extending below said first support member and generally parallel to the axis of rotation of the antenna assembly, and second means depending from said flat support plate and rotatably supporting one of said trunnion means for rotating the antenna assembly about an axis in a first plane that is orthogonal to said axis so that the antenna assembly may be tilted to pivot said axis in a second plane that is orthogonal to the first plane.

10. Apparatus according to claim 9 wherein said bracket means comprises a member having an angle iron shaped cross section with an upright portion thereof rigidly connected to the cylindrical portion of said second support member, a bottom portion of said member being located below said first support member and having said second means attached thereto.

11. Apparatus according to claim 9 wherein said bracket means comprises a first length of a first curved U-shaped means extending up over said second support member and having a base located below said first support member; and means for attaching said first U-shaped member to said second support member; said second means being attached to said base of said first U-shaped means.

12. Apparatus according to claim 9 wherein said second means comprises:

a rigid member having a threaded exterior surface and having a longitudinal axis of said threads;

third means for rigidly attaching said threaded member to said support plate of said bracket means with the longitudinal axis of the threaded member substantially orthogonal to said support plate;

first nut means screwed onto said threaded member;

a rigid tubular shaped enclosure having an opening through one side thereof that is dimensioned for making a smooth sliding fit over said threaded member;

second nut means screwed onto said threaded member with said one side of said tubular enclosure on said threaded member being located between said first and second nut means;

clamp means attached to and rotatably supporting one of said trunnion means of the antenna assembly; and fourth means for rigidly attaching said clamp means to said tubular enclosure so as to support the antenna assembly for rotation about its axis of rotation;

adjustment of the orientation of the axis of rotation of the antenna assembly being varied by screwing said second nut means up and down the circumference of said threaded member whereby the antenna assembly is levelled in a first plane including the axis of rotation of the antenna assembly and being substantially orthogonal to the ground, said first nut means being tightened against said one side of said enclosure in the direction of the second nut means for fixing the orientation of the axis of rotation of the antenna assembly.

13. Apparatus according to claim 12 wherein the exterior of said threaded member is circularly shaped.

14. Apparatus according to claim 13 wherein said rigid member is a pipe having the circumference thereof threaded.

15. Apparatus according to claim 14 wherein said enclosure is regularly shaped.

16. Apparatus according to claim 15 wherein said enclosure has a rectangularly shaped cross section.

17. Apparatus according to claim 16 wherein said first and second nut means are pipe nuts.

* * * * *